US006517682B2

(12) United States Patent
Hendriks et al.

(10) Patent No.: US 6,517,682 B2
(45) **Date of Patent: *Feb. 11, 2003**

(54) PROCESS FOR CONTROLLING DEPOSIT OF STICKY MATERIAL

(75) Inventors: William A. Hendriks, Jacksonville, FL (US); Jeffrey R. Cowart, Jacksonville, FL (US)

(73) Assignee: Hercules Incorporated, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/727,011

(22) Filed: Nov. 30, 2000

(65) Prior Publication Data

US 2001/0000064 A1 Mar. 29, 2001

Related U.S. Application Data

(63) Continuation of application No. 09/363,225, filed on Jul. 30, 1999, now Pat. No. 6,171,445.

(51) Int. Cl.[7] ..... D21F 1/32

(52) U.S. Cl. ..... 162/199; 162/DIG. 4; 162/158; 162/164.3; 162/164.6; 162/166; 162/72

(58) Field of Search ..... 162/199, DIG. 4, 162/158, 164.3, 164.6, 166, 72

(56) References Cited

U.S. PATENT DOCUMENTS 4,995,944 A * 2/1991 Aston et al. ..... 162/199
5,246,548 A * 9/1993 Aston et al. ..... 162/199
5,575,893 A * 11/1996 Khan et al. ..... 162/199

FOREIGN PATENT DOCUMENTS

EP 0 599 440 6/1994

* cited by examiner

*Primary Examiner*—Steven P. Griffin
*Assistant Examiner*—Mark Halpern
(74) *Attorney, Agent, or Firm*—Gary Samuels; Joanne Mary Fobare Rossi

(57) ABSTRACT

Method of inhibiting the deposit of sticky material on a papermill felt used in processing pulp slurry into sheets, comprising applying to the papermill felt at least one cationic polymer and at least one nonionic surfactant having an HLB of about 11 to 14.

24 Claims, 2 Drawing Sheets

PROCESS FOR CONTROLLING DEPOSIT OF STICKY MATERIAL

This is a continuation of application Ser. No. 09/363,225, filed Jul. 30, 1999, now U.S. Pat. No. 6,171,445.

BACKGROUND OF THE INVENTION

1. Field of the Invention

This invention relates to providing clean sheet felting equipment and the like for paper production and, more particularly, to chemical treatment of papermill felts and the like to control the deposit of stir material thereon.

2. Background and Material Information

The manufacture of paper typically involves the processing of a carefully prepared aqueous fiber suspension to produce a highly uniform dry paper sheet. Three steps included in the typical process are sheet fig, where the suspension is directed over a porous mesh or "wire" upon which fibers are deposited while liquid filters through the wire; sheet pressing, where he formed sheet is passed through presses covered wilt porous "felt" to extract retained water from the sheet, to improve the sheet's uniformity, and to impart surface quality to sheet; and paper drying, where residual water is evaporated from the sheet. The sheet may then be further processed into the finished paper product It is well known that evaporation of water is energy intensive and thus relatively expensive. Consequently, efficient papermaking is dependent upon extracting water during the forming and pressing operations, and avoiding sheet defects which render the dried sheet unfit for use. Felts and wires are thus particularly important because they affect not only water removal but, because of their intimate contact with the sheet, the quality of the sheet itself, Deposits allowed to collect on the felt or wire can affect its water removal efficiency, can cause holes in the sheet, and can be transferred to the sheet material to create defects. The quality of the aqueous fiber suspension used to produce the sheet is dependent upon many factors, including the wood and water used as raw materials, the composition of any recycled material added to the process, and the additives used during preparation of the suspension. Thus a variety of dissolved or suspended materials can be introduced into the manufacturing process, including both inorganic materials such as salts and clays, and materials which are organic in nature such as resins or "pitch" from the wood, as well as inks, latex, and adhesives from recycled paper products. A build up of deposits containing inorganic and/or organic materials on felts and other sheet forming equipment during the manufacturing process is recognized as a troublesome obstacle to efficient papermaking. Particularly troublesome are the sticky materials such as glues, resins, gums and the like which are associated with recycled fibers.

Methods of quickly and effectively removing deposits from the papermill sheet forming equipment are of great importance to the industry. The paper machines could be shut down for cleaning, but ceasing operation for cleaning is undesirable because of the consequential loss of productivity. On-line cleaning is thus greatly preferred where it can be effectively practiced.

The wire belt or cylinder used for sheet forming cycles continuously, as a belt, during production. The sheet-contact portion of the cycle begins where application of the fiber suspension to the wire belt or cylinder is started and continues until the formed sheet is separated from the wire surface; and the return portion of the cycle returns the wire from the position where the formed sheet has been removed from its surface to the beginning of the sheet-contact portion. With wire belts such as Fourdrinier wires, on-line wire cleaning has generally been performed during the return stage (i.e., where the wire is not in contact with the forming sheet) by treating the returning wire with a cleaning liquid (typically water); often by showering the wire with liquid under pressure. The showers can be assisted by mechanical surface cleaning. Use of water showers, with or without mechanical assistance, has not proved entirely satisfactory in preventing a build-up of either organic compounds or inorganic deposits on the wires, and additional materials have been used to provide cleaning liquids which are more effective. Predominantly fibrous or inorganic materials have been successfully removed using water-based formulations containing either acids or alkalis formulated with other chemicals such as surfactants. Where organic deposits are prevalent, they have been removed with some success by using organic solvents, including some formulations containing aromatic compounds with low flash points or chlorinated hydrocarbons. In some machines fine-pored fabric belts are now used instead of the more traditional wires.

Papermill felts also commonly circulate continuously in belt-like fashion between a sheet contact stage and a return stage. During the sheet contact stage water is drawn from the sheet usually with the aid of presses and/or vacuum into the pores of the felt. A clean felt, having fine pores which are relatively open, is especially desirable for effective paper manufacture since this allows efficient removal of water from the paper sheet. A felt cleaning procedure should remove both organic and inorganic deposits of both a general and localized nature; maintain felt porosity, and condition the fabric nap without chemical or physical attack on the substrate. Mechanical removal, typically by blade contact, has been used to remove debris from the felt surface. However, cleaning liquids are also utilized to remove troublesome build-up of organic and inorganic deposits. The fabric composition and conformation of many papermill felts makes them susceptible to chemical degradation. The cleaning chemicals should be easily removed by rinsing. Both continuous and shock cleaning is used in most papermills. The chemicals used include organic solvents, often chlorinated hydrocarbons. Acid and alkali based systems are also used, but at lower concentrations than used in wire cleaning. High concentrations of alkali metal hydroxides are often unsuitable for felt cleaning as they "attack" the fabric material.

Some of the more successful organic solvents have been identified as health risks, such as carcinogens, and thus require especially careful handling. Other solvent based products can damage plastic or rubber components used in the paper forming process. One on-line treatment of felts which has been used for several years with some success involves contacting the felt with aqueous solution of cationic surfactants such as alkyldimethyl benzyl ammonium chloride wherein the alkyl group consists of a mixture of $C_{12}H_{25}$, $C_{14}H_{29}$ and $C_{16}H_{33}$ groups. However, experience has shown that some sticky materials still tend to adhere to felts despite treatment with these surfactants. Another felt conditioning practice which has been advocated in the past is application of aqueous solutions of cationic polymers to the felts. However this type of treatment can actually lead to a build-up of deposit of materials derived from the cationic polymers themselves. Other sheet forming equipment such as deckers, filters, screens, and rolls can also become fouled. The process problems and treatments are, as a general rule, similar to the felt system, although certain considerations such as maintaining porosity and avoiding chemical degradation of fabric, which are important in felt cleaning and cleaning certain other fine-pored equipment components, may not be so critical for this other equipment.

Natural resin or gum in fresh wood can vary, depending on the species. Some types of pine wood, especially those containing 2 weight percent or more of resin, are commonly used in only very low percentages due to the gum and resin problems they cause. Papermakers alum or sodium aluminate have been traditionally used to control natural wood resin deposits. These products are added into the total pulp system with the objective of depositing the resin on the fiber. The effectiveness of this approach is limited by such factors as pH, the potential for corrosion, paper sheet formation, and the need to control interaction with other chemicals in the pulp system. Treatments which would permit the unrestricted use of these problem pine wood sources could have significant beneficial economic impact on some pulp and paper producers.

The increasingly more common use of recycled fiber has contributed to more serious build-ups of sticky material during paper formation. The glues, resins, gums, etc. which are found in recycled, secondary fiber tend to adhere to various parts of the paper-forming machine and to resist on-line shower cleaning. The materials which adhere to the felt can seriously affect drainage and paper formation. The end result in the product is holes, and ultimately, in some cases, breaks in the sheet during paper processing. Frequent shutdown may be necessary to solvent wash the felt to remove the particularly sticky material associated with recycled fiber. The advantages of paper recycling can thus be somewhat offset by reduced productivity of the papermaking machines.

Certain organic cleaners which were used frequently in the past have become environmentally undesirable. Thus, greater need has developed for cleaners which remove organic deposits without presenting an environmental hazard. Naturally, formulations used should not be destructive of the felts or other sheet forming equipment. While some materials have been considered to perform satisfactorily under certain conditions, there is still a continuing need for more effective deposit control agents for paper forming, particularly where recycled fiber is used as a raw material.

Another approach to deposit control has been the use of pulp additives such as anionic aryl sulfonic acid-formaldehyde condensates or cationic dicyandiamide-formaldehyde condensates. The additives may function for example as sequestrants, dispersing agents or surface active agents. In particular the cationic dicyandiamide-formaldehyde aminoplast resins have been described as bringing about the attachment of pitch (e.g. resinous matter and gums), in the form of discrete particles, to pulp fibers so that the pitch particles are uniformly distributed on the fibers themselves. Consequently, the amount of pitch which accumulates on the papermaking machine is reportedly reduced without causing dark spots or specks of pitch in the paper product.

Still further, U.S. Pat. No. 4,995,944 to Aston et al., which is incorporated by reference in its entirety, discloses controlling depositions on paper machine felts using cationic polymer and surfactant mixture. For example, this patent discloses a method of inhibiting the deposit of sticky material on a papermill felt used in processing pulp slurry into sheets, comprising applying to the paper.ill felt an aqueous solution which is substantially free of anionic macromolecules and which contains at least about 2 ppm of a cationic polymer having a molecular weight between about 2,000 and 300,000; and which contains a water soluble cationic surfactant, the surfactant having a molecular weight between about 200 and 800, applied in an amount effective to inhibit the buildup of deposits derived from the cationic polymer and wherein the weight ratio of surfactant to polymer is between about 50:1 to 1:1.

Moreover, Aston et al. disclose that the deposit of sticky material from papermaking pulp onto papermill felts and other papermaking equipment used in processing a pulp slurry into sheets can be inhibited by applying to the equipment an aqueous solution containing at least about 2 ppm of a cationic polymer and applying to the equipment an aqueous solution containing compounds selected from the group consisting of water-soluble nonionic and cationic surfactants in an amount effective to inhibit build-up of deposits derived from the cationic polymer. The cationic polymers can be applied together with nonionic and/or cationic surfactant to felts, and the felts resist the build-up of sticky deposits.

Still further, Aston et al. disclose that their invention is also of general applicability as regards the precise nature of nonionic and cationic surfactants which may be used, and a considerable variety of different surfactants can be used in combination with the polymer component, provided that they are water soluble. Suitable nonionic surfactants are disclosed to include condensation products of ethylene oxide with a hydrophobic molecule such as, for example, higher fatty alcohols, higher fatty acids, alkylphenols, polyethylene glycol, esters of long chain fatty acids, polyhydric alcohols and their partial fatty acid esters, and long chain polyglycol partially esterfied or etherified. It is also disclosed that a combination of these condensation products may also be used.

While these processes have improved the reduction in papermaking processes, there is still a need to further reduce the stickies on papermaking machines

SUMMARY OF THE INVENTION

The present invention is directed to methods and compositions for inhibiting the deposit of sticky material on a papermill felt used in processing pulp slurry into sheets.

In one aspect the present invention is directed to methods for inhibiting the deposit of sticky material on a papermill felt used in processing pulp slurry into sheets, comprising applying to the papermill felt at least one cationic polymer and at least one nonionic surfactant having an HLB of about 11 to 14, preferably about 12 to 13, with a preferred value being about 13.

The cationic polymer can comprise a dicyandiamide formaldehyde condensate polymer, and the dicyandiamide formaldehyde condensate polymer can include at least one compound selected from the group consisting of formic acid and ammonium salts as polymerization reactants.

The cationic polymer can be derived from a reaction between formaldehyde, dicyandiamide, formic acid, and ammonium chloride. Moreover, the cationic polymer can be obtained by reaction between an epihalohydrin and at least one amine, or derived from ethylenically unsaturated monomers which contain a quaternary anunonium group. Still further, the cationic polymer can be protonated or contain quaternary ammonium groups. The cationic polymer can be derived by reacting an epihalohydrin with at least one compound selected from the group consisting of diethylamine, dimethylamine, and methylethylamine, and the cationic polymer can be made by reacting epichlorohydrin with dimethylamine dr diethylamine.

The cationic polymer and nonionic surfactant can be applied in at least one aqueous composition, whereby the cationic polymer and nonlionic surfactant can be applied in one aqueous composition and/or applied in separate aqueous compositions.

The concentration of the cationic polymer in the aqueous composition can be at least about 0.0002 weight percent, with a preferred range being about 0.0002 to about 0.02 weight percent.

The weight ratio of nonionic surfactant to cationic polymer can be about 50:1 to 1:50, about 50:1 to 1:1, about 10:1 to 1:1, and about 1:1. The concentration of nonionic surfactant can be at least about 1 ppm. The cationic polymer can be applied at a rate of at least about 0.002 $g/m^2$-min.

The at least one aqueous composition can be continuously applied to the felt, and the cationic polymer is preferably applied at a rate of at least about 0.01 $g/m^2$-min.

The at least one aqueous composition can be intermittently applied to the felt, and the cationic polymer is preferably applied at a rate of at least about 0.02 $g/m^2$-min during an application period.

The at least one nonionic surfactant can comprise condensation products of ethylene oxide with a hydrophobic molecule, including condensation products of ethylene oxide with higher fatty alcohols, higher fatty acids, alkylphenols, polyethylene glycol, esters of long chain fatty acids, polyhydric alcohols and their partial fatty acid esters, and long chain polyglycol partially esterfied or etherified. The at least one nonionic surfactant can comprise at least one linear and/or branched nonionic surfactant, preferably a branched nonionic surfactant. The at least one nonionic surfactant can comprise at least one branched alcohol ethoxylated nonionic surfactant, preferably of a higher fatty alcohol. Preferably the cationic polymer has a molecular weight of about 10,000 to 50,000, more preferably about 10,000 to 20,000 when utilized with the branched nonionic surfactant.

DETAILED DESCRIPTION OF THE INVENTION

Figure 1:
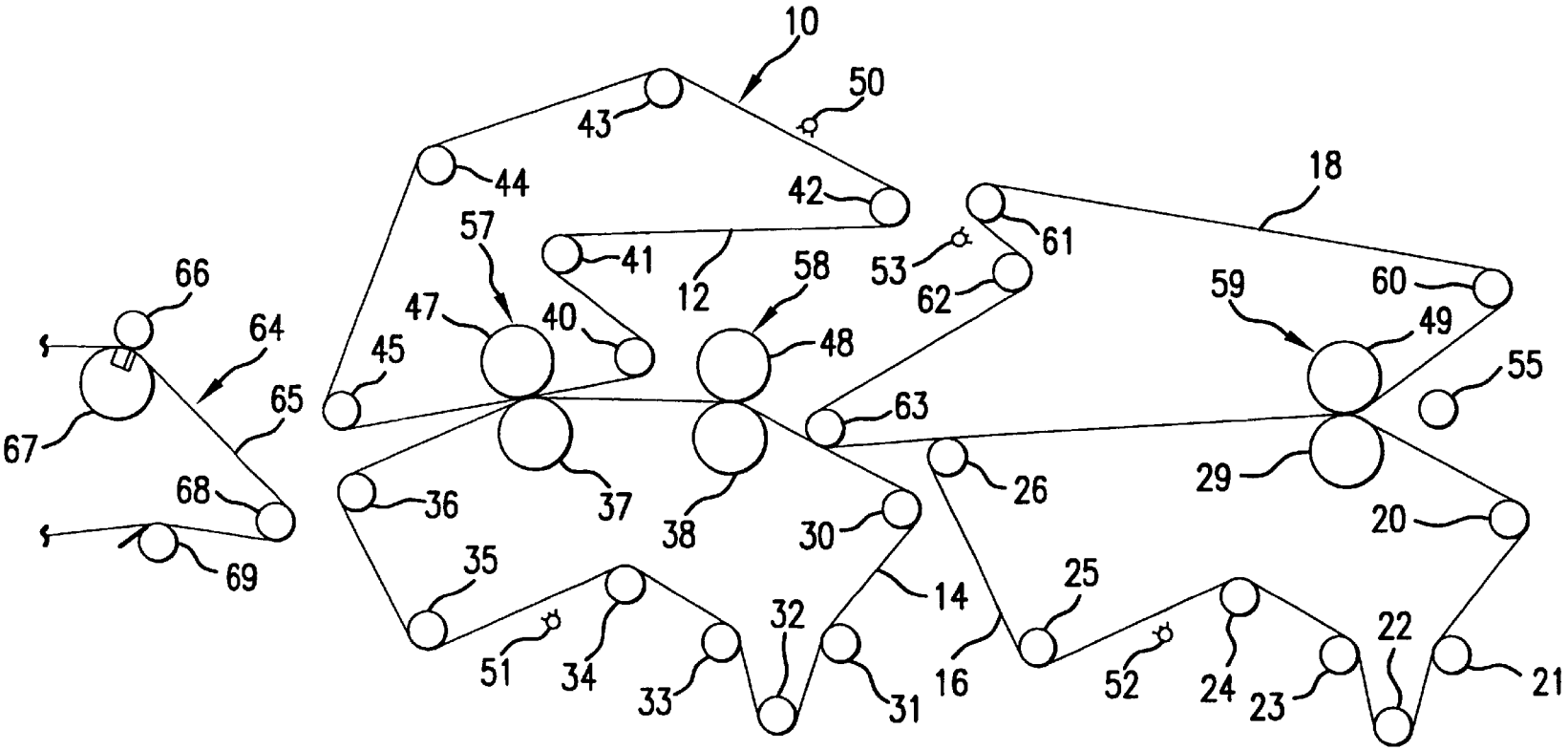
FIG. 1 is a schematic side elevation drawing of felts in a papermaking machine which can be treated in accordance with the present invention.

Unless otherwise stated, all percentages, parts, ratios, etc., are by weight.

Unless otherwise stated, a reference to a compound or component includes the compound or component by itself, as well as in combination with other compounds or components, such as mixtures of compounds.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

The present invention is directed to using aqueous solutions of water-soluble cationic polymers and nonionic water-soluble surfactants to substantially inhibit the deposit of both organic and inorganic deposits on felts or other sheet forming equipment, especially other fine-pored components of such equipment. Treatment, including a cationic polymer in combination with a nonionic surfactant, provides surprisingly effective control of deposits on the treated equipment, even where recycled fiber represents a substantial portion of the pulp formulation. The invention provides a particularly effective felt cleaner and conditioner for paper machines. The present invention is of general applicability as regards the precise nature of the polymer, and a considerable variety of different polymers can be used, provided that they are cationic. Use of polyethylenimihes is considered to be within this invention, as is use of various other polymeric materials containing amino groups such as those produced in accordance with the procedure disclosed in U.S. Pat. Nos. 3,250,664, 3,642,572, 3,893,885 or 4,250,299, which are incorporated by reference herein in their entireties; but it is generally preferred to use protonated or quaternary ammonium polymers. These preferred polymers include polymers obtained by reaction between an epihalohydrin and one or more amines, and polymers derived from ethylenically unsaturated monomers which contain a quaternary ammonium group. The cationic polymers of this invention also include dicyandiamide-formaldehyde condensates. Polymers of this type are disclosed in U.S. Pat. No. 3,582,461, which is incorporated herein in its entirety. Either formic acid or ammonium salts, and most preferably both formic acid and ammonium chloride, may also be included as polymerization reactants. However, some dicyandiamide-formaldehyde condensates have a tendency to agglomerate on felts and the like, even in the presence of cationic surfactants. One dicyandiamide-formaldehyde type polymer is commercially available as Tinofix QF from Ciba Geigy Chemical Ltd. of Ontario, Canada and contains as its active ingredient about 50 weight percent of a polymer believed to have a molecular weight between about 20,000 and 50,000.

Among the quaternary ammonium polymers which are derived from epihalohydrins and various amines are those obtained by reaction of epichlorohydrin with at least one amine selected from the group consisting of dimethylamine, ethylene diamine, and polyalkylene polyamine. Triethanolamine may also be included in the reaction. Examples include those polymers obtained by reaction between a polyalkylene polyamine and epichlorohydrin, as well as those polymers obtained by reaction between epichiorohydrin, dimethylamine, and either ethylene diamine or a polyalkylene polyamine. A typical amine which can be employed is N,N,N',N'-tetramnethylethylenediamine as well as ethylene diamine used together with dimethylamine and triethanolamine. Polymers of this type include those having the formula:

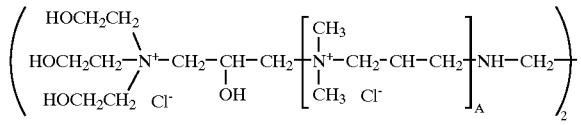

where A is from 0–500, although, of course, other amines can be employed.

The preferred cationic polymers of this invention also include those made by reacting dimethylamine, diethylamine, or methylethylamine, preferably either dimethylamine or diethylamine, with an epihalohydrin, preferably epichlorohydrin. Polymers of this type are disclosed in U.S. Pat. No. 3,738,945, and Canadian Pat. No. 1,096,070, which are incorporated herein in their entirety. Such polymers are commercially available as Agefloc A-50, Agefloc A-50HV, and Agefloc B-50 from CPS Chemical Co., Inc. of N.J., U.S.A. These three products reportedly contain as their active ingredients about 50 weight percent of polymers having molecular weights of about 75,000 to 80,000, about 200,000 to 250,000, and about 20,000 to 30,000, respectively. Another commercially available product of this type is Magnifloc 573C, which is marketed by American Cyanamide Company of N.J., U.S.A. and is believed to contain as its active ingredient about 50 weight percent of a polymer having a molecular weight of about 20,000 to 30,000.

Typical cationic polymers which can be used in the present invention and which are derived from ethylenically unsaturated monomers include homo- and co-polymers of vinyl compounds such as vinyl pyridine and vinyl imidazole which may be quaternized with, say, $C_1$ to $C_{18}$ akyl halide, a benzyl halide, especially a chloride, or dimethyl or diethyl sulphate, or vinyl benzyl chloride which may be quaternized with, say, a tertiary amine of formula $NR_1R_2R_3$ in which $R_1$, $R_2$ and $R_3$ are independently lower alkyl, typically of 1 to 4 carbon atoms, such that one of $R_1$, $R_2$, and $R_3$ can be $C_1$ to $C_{18}$ alkyl; allyl compounds such as diallyldimethyl amnmonium chloride; or acrylic derivatives such as dialkyl aminomethyl(meth)acrylamide which may be quaternized with, say, a $C_1$ to $C_{18}$ alkyl halide, a benzyl halide or dimethyl or diethyl sulphate, a methacrylamido propyl tri($C_1$ to $C_4$ alky, especially methyl) ammonium salt, or a (meth) acryloy-loxyethyl tri($C_1$ to $C_4$ alkyl, especially methyl) ammonium salt, said salt being a halide, especially a chloride, methosulphate, ethosulphate, or 1/n of an n-valent anion. These monomers may be copolymerized with a (meth)acrylic derivative such as acrylamide, an acrylate or methacrylate $C_1$ to $C_{18}$ alkyl ester or acrylonitrile or an alkyl vinyl ether, vinyl pyrrolidone, or vinyl acetate. Typical such polymers contain 10–100 mol % of recurring units of the formula:

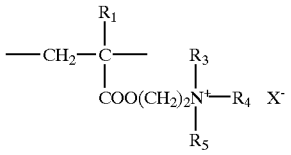

and 0–90 mol % of recurring units of the formula:

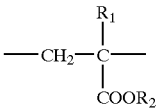

in which $R_1$ represents hydrogen or a lower alkyl radical, typically of 1–4 carbon atoms, $R_2$ represent long chain alkyl group, typically of 8 to 18 carbon atoms, $R_3$, $R_4$, and $R_5$ independently represent hydrogen or a lower all group while X represents an anion, typically a halide ion, a methosulfate ion, an ethosulfate ion, or 1/n of a n-valent anion. Other quaternary ammonium polymers derived from an unsaturated monomer include the homo-polymer of diallyldimethyl ammonium chloride which possesses recurring units of the formula:

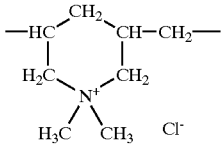

In this respect, it should be noted that this polymer should be regarded as "substantially linear" since although it contains cyclic groupings, these groupings are connected along a linear chain and there is no crosslinking.

Other polymers which can be used and which are derived from unsaturated monomers include those having the formula:

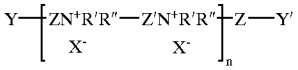

where Z and Z' which may be the same or different is —$CH_2CH{=}CHCH_2$— or —$CH_2$—$CHOHCH_2$—, Y and Y', which may be the same or different, are either X or —NR'R", X is a halogen of atomic weight greater that 30, n is an integer of from 2 to 20, and R' and R" (i) may be the same or different alkyl groups of from 1 to 18 carbon atoms optionally substituted by 1 to 2 hydroxyl groups; or (ii) when taken together with N represent a saturated or unsaturated ring of from 5 to 7 atoms; or (iii) when taken together with N and an oxygen atom represent the N-morpholino group. A particularly preferred such polymer is poly (dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternized. In general, therefore, the polymer will possess recurring units of the formula:

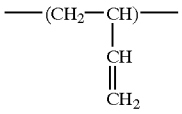

(a)

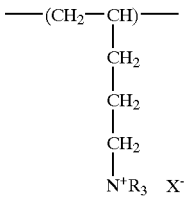

(b)

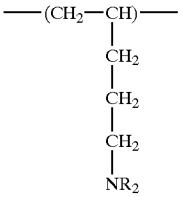

(c)

and

-continued

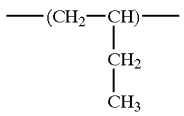

(d)

in the molar proportions $a:b_1:b_2:c$, respectively, where R represents a lower alkyl radical, typically a methyl or ethyl radical. It should be understood that the lower alkyl radicals need not all be the same. Typical quaternizing agents include methyl chloride, dimethyl sulfate, and diethyl sulfate. Varying ratios of $a:b_1:b_2:c$ may be used with the amine amounts $(b_1+b_2)$ being generally from 10–90% with (a+c) being from 90%–10%. These polymers can be obtained by reacting polybutadiene with carbon monoxide and hydrogen in the presence of an appropriate lower alkyl amine.

Other cationic polymers which are capable of interacting with anionic macromolecules and/or sticky material in papermaking pulp may also be used within the scope of this invention. These are considered to include cationic tannin derivatives, such as those obtained by a Mannich-type reaction of tannin (a condensed polyphenolic body) with formaldehyde and an amine, formed as a salt, e.g., acetate, formate, hydrochloride or quaternized, as well as polyamine polymers which have been crosslinked, such as polyamideamine/polyethylene polyamine copolymers crosslinked with, say, epichlorohydrin. Natural gas and starches which are modified to include cationic groups are also considered useful.

The molecular weight of the most useful polymers of this invention is generally between about 2,000 and about 3,000,000, although polymers having molecular weights below 2,000 and above 3,000,000 may also be used with some success. Preferably the molecular weight of the polymer used is at least about 10,000, and is most preferably at least about 20,000. Preferably the molecular weight of the polymer used is about 300,000 or less, and is most preferably about 50,000 or less. The polymers most preferably have a molecular weight within the range of about 10,000 to about 50,000, more preferably 10,000 to 20,000. Mixtures of these polymers may also be used.

Suitable nonionic surfactants according to the present invention are water soluble nonionic surfactants having an HLB of about 11 to 14, more preferably about 12 to 13, with a preferred value being about 13. Such nonionic surfactants include, but are not limited to, condensation products of ethylene oxide with a hydrophobic molecule such as, for example, higher fatty alcohols, preferably C10 to C15 and combinations thereof, fatty alcohols, higher fatty acids, preferably C10 to C14 fatty acids and combinations thereof, alkylphenols, polyethylene glycol, esters of long chain fatty acids, polyhydric alcohols and their partial fatty acid esters, and long chain polyglycol partially esterfied or etherified. A combination of nonionic surfactants may also be used.

Preferred nonionic surfactants include condensation products of ethylene oxide with higher fatty alcohols, such as the Surfonic L and TDA—Series from Huntsman Inc. and the Neodol Series from Shell Chemicals; alkylphenols, such as Igepal Co Series of nonyl phenol ethoxylate and the Igepal Ca Series of octyl phenol ethoxylate from Rhone-Poulenc; the glycol esters of long chain fatty acids, such as MAPEG—polyethylene glycol esters from Mazer Chemicals; and polyhydric alcohols, such as MAZON—polyoxyethylene sorbitol hexoleate from Mazer Chemicals, and Tween—ethoxylated sorbitan esters from ICI, Americas.

The nonionic surfactant can be linear or branched, and is preferably branched. Preferably, the nonionic surfactant comprises branched nonionic surfactant, preferably one or more branched alcohol ethoxylates, such as Surfonic TDA-8, available from Huntsman Inc., in combination with a lower molecular weight cationic polymer, such as a cationic polymer having a molecular weight of between about 10,000 and 50,000, more preferably about 10,000 to 20,000, such as Polyplus 1290 available from BetzDearborn Inc.

Additional surfactants can be utilized in combination with the nonionic surfactants of the present invention. Thus, a considerable variety of different surfactants can be used in conjunction with the cationic polymer component and nonionic surfactant of the present invention, provided that these additional surfactants are water soluble. For example, the additional surfactants can comprise nonionic surfactants that have different HLB values than those of the present invention, such as those disclosed in U.S. Pat. No. 4,995,944, which is incorporated by reference herein in its entirety.

Still further the additional surfactants can comprise cationic surfactants, such as those disclosed in U.S. Pat. No. 4,995,944, which is incorporated by reference herein in its entirety. Thus, the additional cationic surfactants can include water soluble surfactants having molecular weights between about 200 and 800 and having the general formula

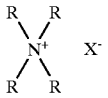

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms and preferably an n-alkyl group having between about 12 and 16 carbon atoms; and wherein X is an anion, typically a halide ion (e.g. chloride), or 1/n of an n-valent anion. Mixtures of these compounds can also be used as the surfactant of this invention.

Preferably two of the R groups of the cationic surfactants of the formula are selected from the group consisting of methyl and ethyl, and are most preferably methyl; and preferably one R group is selected from the aralkyl groups

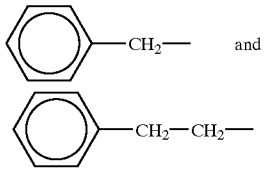

and is most preferably benzyl. Particularly useful cationic surfactants thus include alkyl dimethyl benzyl ammonium chlorides having alkyl groups with between about 12 and 16 carbon atoms. One commercially available product of this type includes a mixture of alkyl dimethyl benzyl ammonium chlorides wherein about 50% of the surfactant has a $C_{14}H_{29}$ n-alkyl group, about 40% of the surfactant has a $C_{12}H25$ n-alkyl group, and about 10% of the surfactant has a $C_{16}H_{33}$, n-alkyl group. This product is known for its microbicidal effectiveness. The cationic surfactants can also include the group of pseudo-cationic materials having a molecular weight between about 1,000 and about 26,000 and having the general formula $NR_1R_2R_3$, wherein $R_1$ and $R_2$ are polyethers such as polyethylene oxide, polypropylene oxide or a combined chain of ethylene oxide and propylene oxide, and wherein $R_3$ is selected from the group consisting of polyethers, alkyl groups, or hydrogen. Examples of this type of surfactant are disclosed in U.S. Pat. No. 2,979,528, which is incorporated by reference in its entirety.

The cationic polymers and the nonionic surfactants of this invention are applied in aqueous solution directly to the equipment being treated. The treatment dosage of cationic polymer and nonionic surfactant should generally be adjusted to the demands of the particular system being treated. The cationic polymers and nonionic surfactants of this invention are typically supplied as liquid compositions comprising aqueous solutions of the cationic polymer and/or nonionic surfactant. Cationic polymer concentrations in the compositions may range from the relatively dilute solutions having cationic polymer concentrations suitable for continuous application, up to the solubility or gelling limits of the cationic polymer, but generally the compositions are relatively concentrated for practical shipping and handling purposes.

Indeed, the liquid compositions may comprise additional materials which further the dissolution of the polymers so as to allow more concentrated compositions. An example of these materials are alkoxyethanols such as butoxyethanol. Aqueous compositions suitable for shipping and handling will generally contain between 5 and 50 weight percent, active, of the cationic polymer of this invention. While the nonionic surfactants of this invention may be supplied as compositions separate from the polymer compositions and then either applied to the felts separately (e.g. by using separate shower systems) or mixed prior to application, it is preferred to provide aqueous compositions comprising the nonionic surfactant as well as the cationic polymer.

While other agents may also be present in the compositions of this invention, useful compositions may be provided in accordance with this invention which contain a pitch control agent comprising or consisting essentially of the above-described nonionic surfactants and cationic polymers. In general, aqueous compositions suitable for shipping and handling will contain between 5 and 50 weight percent total of the cationic polymer and nonionic surfactant components. The weight ratio of nonionic surfactant to cationic polymer in such combined compositions is generally between about 50:1 and 1:50. Preferably the weight ratio of nonionic surfactant to cationic polymer in the aqueous composition is between about 10:1 and about 1:1, especially where oils may potentially be present; and is most preferably about 1:1 for general application, although excess surfactant (e.g. a weight ratio of 1:1:1; or more) may be considered most suitable in the event oils might be present.

Preferably, the cationic polymer is present from about 0.1 to 50 wt % of the aqueous composition, more preferably about 5 to 35 wt % of the aqueous composition. The nonionic surfactant is preferably present from about 0.1 to 30 wt % of the aqueous composition, more preferably about 5 to 15 wt % of the aqueous composition.

One aqueous formulation considered particularly suitable for separate application of the polymer component in conjunction with additional application of the surfactant is available commercially from BetzDearborn Chemical Co., of Trevose, Pa. and comprises about 17 weight percent, active, of a polymeric condensation product of formaldehyde, ammonium chloride, dicyandiamide and formic acid which has a molecular weight believed to be about 20,000 to 50,000, about 2 weight percent, active, of a polymer derived by reacting epichlorohydrin with dimethylamine which has a molecular weight believed to be about 20,000 to 30,000, and about 8 weight percent of butoxyethanol. Lesser amounts of other materials, including about 0.4% active of an alkyldimethyl ammonium chloride surfactant containing the mixture of $C_{12}$, $C_{14}$ and $C_{16}$ n-alkyl substituents described above are also present in the product, but are not considered essential to its utility for separate addition. In particular the relative amount of alkyldimethyl ammonium chloride surfactant in this product is considered insufficient to activate the polymer deposit inhibiting effect of this invention.

Another aqueous formulation considered particularly suitable for separate addition of the polymer, also available commercially from BetzDearborn Chemical Co., comprises about 17 weight percent, active, of a poly(hydroxyalkylene dimethyl ammonium chloride) having a molecular weight of about 20,000. An aqueous formulation considered particularly suitable for separate addition of the surfactant to this invention, also available commercially from BetzDearborn Chemical Co., comprises about 16% active of the alkyldimethyl benzyl ammonium chloride surfactant mixture described above.

The most appropriate treatment dosage depends on such system factors as the nature of the adhesive material, and whether cleaning is continuous or periodic. Even liquid compositions comprising relatively high concentrations of a polymer of the invention (for example, 50%) may be employed at full strength (100% as the liquid composition), for example by spraying the undiluted liquid composition directly onto the felts. However, particularly where continuous treatment is practiced, the compositions may be advantageously diluted at the treatment location with clean fresh water or other aqueous liquid. Where necessary for water economy, a good quality process water may be adequate for dilution The advantages of this invention can be realized at application concentrations as low as 2 ppm of the polymer, especially where continuous treatment is practiced, and, as explained further below, sufficient surfactant to inhibit a build-up of deposits derived from the applied cationic polymer component.

"Continuous treatment" of felt as used herein means that the felt is routinely treated at least once during the cycle between its sheet contact stage and its return stage. This routine treatment is most advantageously applied during the early portion of return stage. The felt can then be contacted with the sheet such that even the sticky material, including that typically associated with recycled fibers, is inhibited from adhering to the felt, and that material which does deposit is more readily washed away when aqueous wash solution is applied during the return stage. In some cases, continuous treatment is not practical and treatment with the cationic polymers and surfactants of this invention may be periodic. For example, aqueous solutions of the polymer and surfactant may be sprayed on the felt until the felt is satisfactorily conditioned and the spray may then be discontinued until supplemental conditioning is needed to further inhibit the build-up of deposits on the felt.

Treatment procedures are more specifically described by reference to the model papermaking felt systems schematically represented in simplified form in FIGS. 1 and 2. The press felt system represented generally as (10) in FIG. 1 comprises a top press felt (12), a bottom press felt (14) a final press bottom felt (16) and final press top felt (18). Final press bottom felt (16) is shown wound about a series of rolls (20), (21), (22), (23), (24), (25), and (26) and press roll (29); bottom press felt (14), is shown wound about a series of rolls (30), (31), (32), (33), (34), (35) and (36) and press rolls (37) and (38); top press felt (12) wound about a series of rolls (40), (41), (42), (43), (44) and (45) and press roll (47); and final press top felt is shown wound about the press roll 49 and a series of rolls (60), (61), (62) and (63). Both top press felt (12) and bottom press felt (14) pass between press rolls (37) and (47). Bottom press felt (14) passes between press rolls (38) and (48); and both final bottom press felt (16) and final press top felt (18) pass between press rolls (29) and (49). Showers for washing the top press felt (12), the bottom press felt (14), the final press bottom felt (16) and the final press top felt (18) are respectively shown at (50), (51), (52) and (53). A sheet support roll is shown at (55). Press (57) comprises press rolls (37) and (47); press (58) comprises press rolls (38) and (48); and press (59) comprises press rolls (29) and (49).

The press felt system (10) is shown in FIG. 1 positioned to receive sheet material from a Fourdrinier wire-type machine represented only partially by (64) in FIG. 1, wherein a wire (65) is designed to receive an aqueous paper stock from a head box (not shown). Liquid then filters through openings in the wire as the wire travels during its sheet contact stage to a lump breaker roll (66) and a couch roll (67) which are generally provided to physically compress the sheet material and remove it from the wire (65). The wire (65) then passes over the head roll (68) and returns to receive additional paper stock. The return is typically directed past a series of showers (not shown), and wash rolls such as that shown at (69). Other showers (not shown), may be provided for particular components of the system, such as the lump broken roll (66) or the head roll (68).

During operation of the felt system shown in FIG. 1, sheet material removed from the wire (65) after couch roll (67) is directed between rolls (45) and (36) and pressed between the top press felt (12) and the bottom press felt (14) by press rolls (37) and (47) of press (57). The sheet material then travels along with bottom press felt (14) to press (58) where it is pressed between the bottom press felt and press roll (48) using press roll (38). The sheet material is then removed from the bottom press felt (14) and travels on to press (59) where it is pressed between the final press bottom felt (16) and the final press top felt (18) by press rolls (29) and (49) of press (59). The sheet material is then removed from the final press felt (16) and travels over support roll (55) and on to further processing equipment such as dryers (not shown). In the press felt system (10) as shown in FIG. 1, the sheet contact stage of the top press felt (12) lasts from roll (45) or some point between roll (45) and press (57) until some point after sheet contact stage of the bottom press felt (14) lasts from some point between roll (36) and press (57); until some point after press (58); the sheet contact stage of final press bottom felt (16) lasts from roll (26) until some point after press (59); and the sheet contact stage of final press top felt (18) lasts from some point between roll (63) and press (59) until some point after press (59).

It will be evident that additional equipment such as various presses, rolls, showers, guides, vacuum devices, and tension devices may be included within the felt system 10. In particular wringer presses for pressing moisture from the felts themselves may be provided. Moreover some of the equipment shown such as press (58) and final press top felt (18) may be omitted from a felt system. It will be further evident to one of ordinary skill in the art that felt systems are highly variable both with regard to the number of felts used and the design of the felt cycling systems.

Felt systems are also used in conjunction with papermaking processes which do not employ Fourdrinier wire formers. One such alternate system, which is especially useful for producing heavier sheet material, uses vat formers. The initial stages of a vat forming system are represented generally in FIG. 2. The system (70) comprises a series of wire cylinders (i.e. vats) as those shown at (72) and (73) which rotate so that a portion of the cylinder is brought into contact with the pulp slurry and is then rotated to deposit a layer of paper web onto a bottom couch felt (75). In addition to the bottom couch felt (75) the system (70) comprises a first top couch felt (76) and a second top couch felt (77). Couch rolls (78) and (79) are provided to aid in the transfer of sheet material from the vats (72) and (73) respectively onto the bottom couch felt (75). The bottom couch felt (75) is shown wound about couch rolls (78) and (79), roll (80), suction drum (81) and press rolls (83), (84), (85) and (86) The first top couch felt is shown wound about rolls (88), (89) and (90) and suction drum couch roll (91); and the second top couch felt is shown wound about press rolls (93), (94), (95) and (96) and rolls (97), (98), (99) and (100). Both the bottom couch felt (75) and the first top couch felt (76) pass between the suction drum (81) and the suction drum couch roll (91) which vacuum water from the felts and fiber web. Both the bottom couch felt (75) and the second top couch felt (77) pass between press rolls (83) and (93), between press rolls (84) and (94), between press rolls (85) and (95), and between press rolls (86) and (96). Press (103) comprises press rolls (83) and (93); press (104) comprises press rolls (84) and (94); press (105) comprises press rolls (85) and (95); and press (106) comprises press rolls (86) and (96).

Showers for washing the bottom couch felt (75), the first top couch felt (76) and the second top couch felt (77) are respectively shown at (107), (108) and (109). During operation of the felts shown in FIG. 2, sheet material removed from the vats (72) and (73) travels on the bottom couch felt (75) over the suction drum and is pressed between the bottom couch felt and the second top couch felt (77) by each of the presses (103), (104), (105) and (106). The sheet material is then separated from the couch felts (75) and (77) and is directed onto further processing equipment such as the felt system (10) shown in FIG. 1. In the system shown in FIG. 2 the sheet contact stage of the bottom couch felt (75) lasts from the vat (72) until just after press roller (86); the sheet contact stage of the first top couch felt is at the suction drum couch roll; and the sheet contact state of the second top couch felt lasts from about roll (100) to until just after press roller (96). It will be evident that additional equipment such as vats, presses, rolls, showers, guides, vacuum devices, and tension devices may be included within the system (70). Moreover some of the equipment shown may be omitted from a vat forming system. It will be fairly evident to one of ordinary skill in the art that vat forming systems are highly variable both with regard to the number of felts used and the design of the felt cycling systems.

Figure 2:
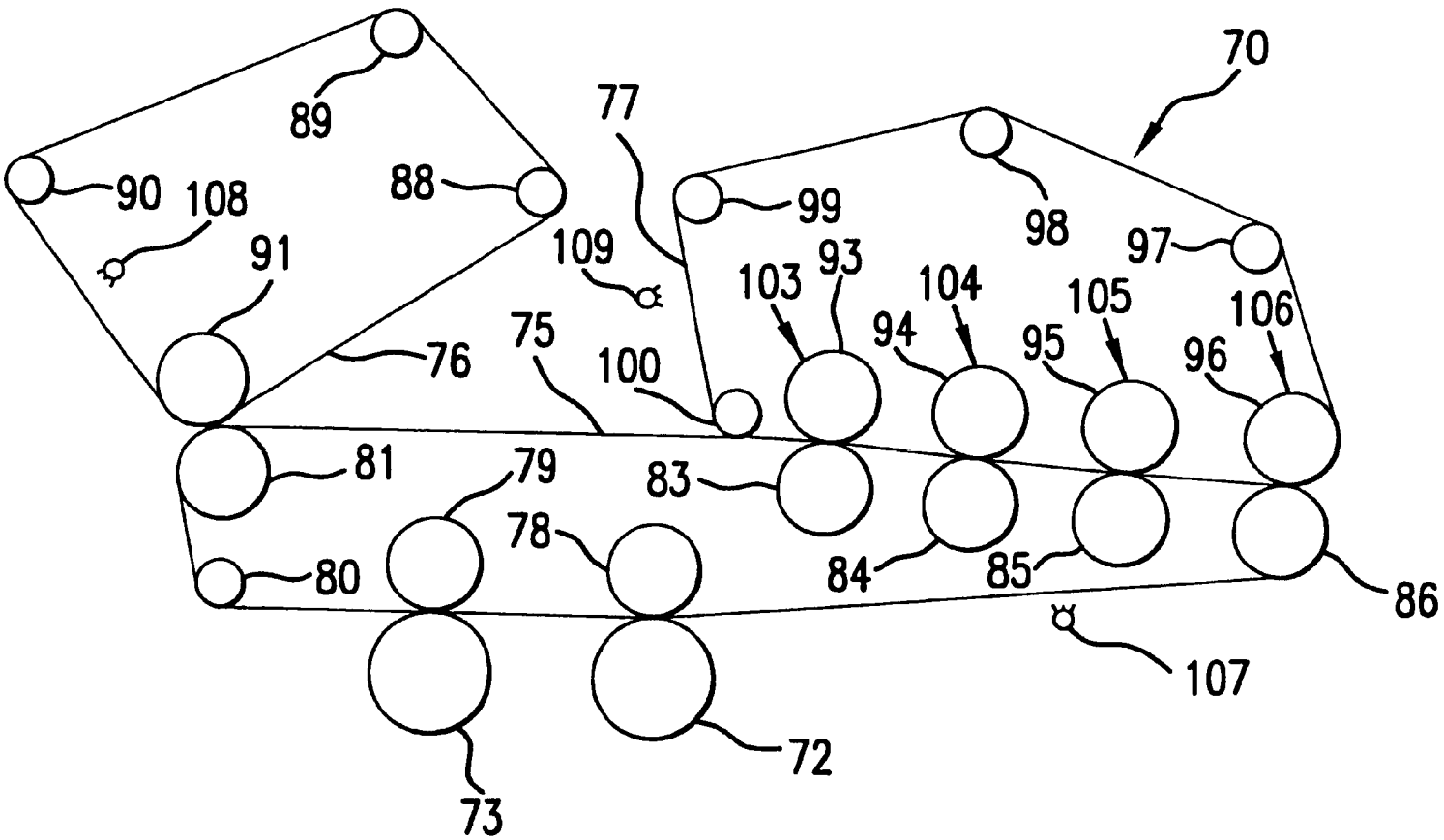
FIG. 2 is a schematic side elevation drawing of felts in a vat forming papermaking machine which can be treated in accordance with the present invention.

Each felt (12), (14), (16), (18), (75), (76) and (77) of the systems illustrated in FIGS. 1 and 2 can be continuously treated in accordance with this invention by applying an aqueous solution of suitable cationic polymer and surfactant to the felt anywhere along its return stage (i.e. from the point the felt is separated from contact with sheet material to the point it is again brought into contact with sheet material). Preferably the solution is sprayed onto the felt early in its return stage, so that adhesive material transferred from the sheet material to the felt can be quickly treated. However, the treatment location is often restricted by felt system design. Thus, showers such as shown at (50), (51), (52), (53), (107), (108) and (109) in FIGS. 1 and 2 may be used for treatment purposes. In cases where the applied solution is of a higher concentration than needed for continuous treatment, the application can be interrupted and then resumed as needed. For example, where a shower such as those shown at (50), (51), (52), (53), (107), (108) and (109) is used to apply the solution, it may be intermittently activated and turned off according to the demands of the system. Equipment other than felts may be similarly treated in a manner compatible with their process operation.

For typical papermaking processes, particularly those using substantial amounts of recycled fiber, the cationic polymer is generally applied at a rate at least about 0.002 grams per square meter of felt per minute ($g/m^2$-min), preferably about 0.01 $g/m^2$-min or more where continuous treatment is used, and preferably about 0.02 $g/m^2$-min or more during the application period where application is intermittent. Preferably polymer application rates of 0.5 grams per square meter per minute or less are used to minimize the potential for felt plugging. Thus, for standard papermaking machines with felt widths of 2 to 7 meters and felt lengths of 10 to 40 meters, the application rate is commonly between about 0.02 and 20 grams of polymer per minute per meter width (i.e. g/m-min), more commonly between about 0.05 and 12.5 g/m-min. One technique involves applying 1 g/m-min or more initially, until the felt is conditioned. Once conditioning has been accomplished, maintenance polymer application rates may be lower, or as explained above, application may even be discontinued periodically. The surfactant is applied to felts at a rate effective to inhibit build-up of deposits derived from the applied polymer and thus, is important in controlling felt plugging. Accordingly the weight ratio of surfactant to polymer is generally kept between about 50:1 and 1:50. Preferably, in order to provide sufficient surfactant to control the build-up of deposits derived from the polymer and to offer protection from incidental amounts of dirt and oily materials from the pulp the weight ratio of surfactant to polymer is about 1:1 or more; and in order to avoid applying excessive surfactant, the weight ratio of surfactant to polymer is preferably about 10:1 or less. Most preferably the ratio of the two components is about 1:1. In any case, we prefer to apply the surfactant at a concentration of at least about 1 ppm. Other equipment such as wires, screens, filters, rolls, and suction boxes, and materials such as metals, granite, rubber, and ceramics may also be advantageously treated in accordance with this invention. However, the invention is particularly useful in connection with treating felts and like equipment components with pores suitable for having water drawn therein (i.e. relatively fine pores) where the build-up of substantial deposits derived from the polymer is undesirable; as opposed for example to other equipment such as metal and plastic wires having relatively large pores for draining water therethrough, where a certain amount of deposit build-up is not considered to create undesirable problems.

In any case, the concentration of cationic polymer in the aqueous solution ultimately applied to the felt or other papermaking equipment is preferably at least about 0.0002 weight percent. Preferably, in order to enhance the uniformity of distribution of the polymer, continuous treatment of felt through a felt shower system in accordance with this invention will be conducted with an aqueous shower solution having between about 0.0002 weight percent and about 0.02 weight percent of cationic polymer.

Practice of the invention will become further apparent from the following non-limiting examples.

EXAMPLES

The invention is illustrated in the following non-limiting examples, which are provided for the purpose of representation, and are not to be construed as limiting the scope of the invention. All parts and percentages in the examples are by weight unless indicated otherwise.

Compositions were prepared and subjected to weight gain and porosity testing, as follows:

Weight Gain Test

The Weight Gain Test Apparatus is composed of a pneumatically driven piston and alternating centrifugal pumps that feed contaminant and product into a piston chamber which are pressed through a new test felt sample while under constant pressure. The felt samples are circles die cut from a roll to fit within the piston chamber and supported by a heavy mesh screen. Each up/down stroke of the piston completes a cycle and a set number of cycles completes a test run. The contaminant and product are fed from two stainless steel eight gallon vessels with independent temperature and mixing controls, vessel A holding contaminant, and vessel B holding a composition to be tested. Utilizing these testing apparatus, two distinct procedures can be performed.

In Procedure B, the contaminant vessel A of the Weight Gain Test Apparatus holds the contaminant test system which is adjusted to neutral pH and ambient temperature. Product vessel B holds product at select concentrations at a neutral pH and ambient temperature. Alternating cycles of contaminant and product are passed through a test felt of known initial parameters of weight and porosity for a set number of cycles of about 250–300 to constitute a test run. After each test run, the felt is removed, dried, and percent changes of weight are recorded. For control runs, no product is added to vessel B.

In Procedure A, the contaminant and product are mixed together in vessel A, and the combination is recycled through the test felt. This procedure is very useful in screening for potentially effective products while conserving raw materials. Again, for control runs, no product is added.

Frazier Air Porosimeter:

A Frazier Air Porosimeter, Model No. 5052 from Frazier Precision Instrument Co., Inc., Gaithersburg, Md., is used to measure air flow, e.g., porosity, through test felts in cubic feet per minute before and after being subjected to either Procedure A or Procedure B of the Weight Gain Test. The test felt is clamped onto the air chamber and air flow is gradually increased until the oil level on one side of a manometer reaches a height of 0.5 inches. The corresponding oil level on the other side is then recorded. The oil level is then converted from inches of oil to cubic feet per minute by a given conversion formula.

The compositions that are tested are indicated in Table 1, as follows:

TABLE 1

| Ingredients | COMPOSITIONS | | | | | | | | |
|---|---|---|---|---|---|---|---|---|---|
| (wt %) | A | B[8] | C | D | E | F | G | H | I |
| Marquat 1412[1] | 18.8 | | | | | | | | |
| Surfonic L24-9[2] | | | 8.0 | 8.0 | 8.0 | 8.0 | | | |
| Surfonic L24-7[3] | | | | | | | | 8.0 | 8.0 |
| Surfonic TDA-8[4] | | | | | | | 8.0 | | |
| Cytec C-573[5] | 15.0 | | 15.0 | 20 | | | | 30.0 | 15.0 |

TABLE 1-continued

| Ingredients (wt %) | COMPOSITIONS A | B[8] | C | D | E | F | G | H | I |
|---|---|---|---|---|---|---|---|---|---|
| Polyplus 1279[6] | | | | | 15.0 | 20.0 | | | |
| Polyplus 1290[7] | | | | | | | 25.0 | | |
| Water | 66.2 | | 77.0 | 72.0 | 77.0 | 72.0 | 67.0 | 62.0 | 77.0 |

[1]Maquat 1412 is a quaternary alkyldimethylbenzyl ammonium chloride (cationic surfactant) available from Mason Chemical Co.
[2]Surfonic L24-9 is a nonionic linear ethoxylated C12–C14 fatty alcohol having a HLB of 13.0 available from Huntsman Inc., Austin, TX.
[3]Surfonic L24-7 is a nonionic linear ethoxylated C12–C14 fatty alcohol having a HLB of 11.9 available from Huntsman Inc., Austin, TX.
[4]Surfonic TDA-8 is a nonionic branched ethoxylated C13 tridecyl fatty alcohol having a HLB of 13.4 available from Huntsman Inc., Austin, TX.
[5]Cytec C-573 is a branched condensation polymer of epichlorohydrin/dimethyl amine/ethylene diamine having a molecular weight of about 150,000 available from Cytec Inc.
[6]Polyplus 1279 is a branched condensation polymer of epichlorohydrin/dimethyl amine/ethylene diamine having a molecular weight of about 500,000–600,000 available from BetzDearborn Chemical Co., Trevose, PA.
[7]Poluplus 1290 is a linear condensation polymer of epichlorohydrin/dimethyl amine having a molecular weight of about 10,000–20,000 available from BetzDearborn Chemical Co., Trevose, PA.
[8]A mixture of two anionic surfactants.

Examples 1–9

The following tests show effectiveness of compositions according to the present invention compared to control and conventional compositions, especially at equal costs using a wet strength contaminant test system using Kymene Plus, at room temperature and at a pH of 7.0 using Weight Gain Test Procedure A and porosity test as previously described.

The wet strength contaminant test system includes the following or multiples thereof:

| Alkaline Fine Contaminant Test System | |
|---|---|
| Hard Tap Water | 3945.13 g |
| 2.25% Potassium Hydroxide | 8.87 g |
| 5.00% Pamak Tp | 8.00 g |
| WSR Contaminant[1] | 32.00 g |
| 6.00% Carboxymethyl Cellulose | 6.00 g |
| | 4000.00 g |

| | |
|---|---|
| 1-WSR Contaminant | 5.00 g - Cured Kymene Plus (@ 75° C. for 30 min.) |
| | 1.88 g - Clay |
| | 0.94 g - Talc |
| | 0.31 g - Titanium Dioxide |
| | 91.87 g - DI water |
| | 100.00 g - Blended @ high speed for 15 min. |

The results are depicted in Table 2 below.

TABLE 2

| Example No. | Composition Tested (ppm) | % Change Weight (Weight Gain) | % Change of Porosity Poroisty Loss |
|---|---|---|---|
| 1 | Control (No Treatment) | 16.85 | 51.62 |
| | | 17.95 | 47.39 |
| | | 15.77 | 43.62 |
| | | Average 16.86 | Average 47.54 |

TABLE 2-continued

| Example No. | Composition Tested (ppm) | % Change Weight (Weight Gain) | % Change of Porosity Poroisty Loss |
|---|---|---|---|
| 2 | Composition A (900 ppm) | 14.23 | 42.93 |
| | | 13.33 | 43.31 |
| | | Average 13.78 | Average 43.12 |
| 3 | Composition D (900 ppm) | 8.00 | 28.38 |
| | | 9.44 | 28.91 |
| | | Average 8.72 | Average 28.65 |
| 4 | Composition G (1200 ppm) | 9.67 | 26.56 |
| | | 8.00 | 30.09 |
| | | 7.99 | 26.81 |
| | | Average 8.55 | Average 27.82 |
| 5 | Composition G (1035 ppm) | 9.67 | 26.56 |
| | | 8.00 | 30.09 |
| | | Average 8.84 | Average 28.33 |
| 6 | Composition A (600 ppm) | 14.75 | 55.1 |
| 7 | Composition D (600 ppm) | 11.23 | 34.36 |
| 8 | Composition G (690 ppm) | 9.92 | 33.84 |
| 9 | Composition G (800) | 9.92 | 33.84 |
| | | 9.91 | 34.03 |
| | | Average 9.92 | Average 33.94 |

Example 10–15

The following additional tests show effectiveness of compositions according to the present invention compared to control and conventional compositions, especially at equal costs using the above described wet strength contaminant test system using Kymene Plus, at room temperature and at a pH of 7.0 using Weight Gain Test Procedure A and porosity test as previously described.

The results are depicted in Table 3 below.

TABLE 3

| Example No. | Composition Tested (ppm) | % Change Weight (Weight Gain) | % Change of Porosity Poroisty Loss |
|---|---|---|---|
| 10 | Control (No Treatment) | 14.96 | 84.42 |
| | | 14.34 | 83.78 |
| | | 14.65 | 84.10 |
| | | Average 14.65 | Average 84.10 |
| 11 | Composition A (900 ppm) | 6.53 | 33.41 |
| 12 | Composition C (900 ppm) | 7.9 | 24.35 |
| 13 | Composition D (900 ppm) | 4.71 | 11.69 |
| | | 4.65 | 12.23 |
| | | Average 4.68 | Average 11.96 |
| 14 | Composition E (900 ppm) | 10.65 | 26.85 |
| 15 | Composition F (900 ppm) | 8.68 | 21.13 |

Examples 16–20

The following tests show effectiveness of compositions according to the present invention compared to control and conventional compositions, especially at equal costs using an alkaline fine with hard tap water, at room temperature and at a pH of 7.0, at approximately equal cost concentrations, using, Weight Gain Test Procedure A and porosity test as previously described.

The alkaline fine contaminant test system includes the following, or multiples thereof:

| Alkaline Fine Contaminant Test System | |
|---|---|
| Hard Tap Water | 3992.7 g |
| $CaCO_3$ | 2.1 g |
| Clay | 0.6 g |
| $TiO_2$ | 0.3 g |
| ASA:Starch (10 wt %) | 3.0 g |
| DPP-8695 (1 wt %) | 1.3 g |
| | 4000 g |

The results are depicted in Table 4 below.

TABLE 4

| Example No. | Composition Tested (ppm) | % Change Weight (Weight Gain) | % Change of Porosity Poroisty Loss |
|---|---|---|---|
| 16 | Control (No Treatment) | 12.00 | 31.33 |
| 17 | Composition B (75 ppm) | 8.33 | 18.64 |
| 18 | Composition E (200 ppm) | 2.00 | 4.78 |
| 19 | Composition E (200 ppm) w/TDA-8[1] | 2.55 | 7.43 |
| 20 | Composition G (175 ppm) | 0.85 | 3.29 |

1—TDA-8 is a tridecyl ethoxylated higher fatty alcohol available from Huntsman Inc.

Examples 21–23

The following tests show effectiveness of compositions according to the present invention compared to control and conventional compositions using the above-described alkaline fine contaminant with hard tap water, at room temperature and at a pH of 8.0, at approximately equal cost concentrations, using Weight Gain Test Procedure A and porosity test as previously described.

The results are depicted in Table 5 below.

TABLE 5

| Example No. | Composition Tested (ppm) | % Change Weight (Weight Gain) | % Change of Porosity Poroisty Loss |
|---|---|---|---|
| 21 | Control (No Treatment) | 15.81<br>15.84<br>Average 15.83 | 57.51<br>60.82<br>Average 59.17 |
| 22 | Composition B (75 ppm) | 4.50<br>4.83<br>Average 4.67 | 15.08<br>18.27<br>Average 16.68 |
| 23 | Composition E (211 ppm) | 1.57<br>1.35<br>Average 1.46 | 5.57<br>4.72<br>Average 5.15 |

Examples 24–30

The following tests show conventional compositions using the above-described alkaline fine contaminant with hard tap water, at room temperature and at a pH of 8.0, at approximately equal cost concentrations, using Weight Gain Test Procedure B and porosity test as previously described.

The results are depicted in Table 6 below.

TABLE 6

| Example No. | Composition Tested (ppm) | % Change Weight (Weight Gain) | % Change of Porosity Poroisty Loss |
|---|---|---|---|
| 24 | Control (No Treatment) | 16.36<br>16.87<br>Average 16.62 | 36.19<br>45.80<br>Average 41.00 |
| 25 | Composition B (75 ppm) | 8.45<br>7.79<br>Average 8.12 | 23.39<br>25.51<br>Average 24.45 |
| 26 | Composition E (211 ppm) | 1.78<br>1.81<br>Average 1.80 | 4.70<br>6.86<br>Average 5.78 |
| 27 | Composition C (175 ppm) | 1.51 | 4.92 |
| 28 | Composition D (150 ppm) | 0.38 | 2.79 |
| 29 | Composition E (175 ppm) | 0.83 | 4.31 |
| 30 | Composition F (150 ppm) | 0.53 | 3.33 |

Examples 31–34

The following tests show effectiveness of compositions according to the present invention compared to a control composition, especially at equal costs using the above-described wet strength contaminant test system using Kymene Plus, at room temperature and at a pH of 7.0, using Weight Gain Test Procedure A and porosity test as previously described.

The results are depicted in Table 7 below.

TABLE 7

| Example No. | Composition Tested (ppm) | % Change Weight (Weight Gain) | % Change of Porosity Poroisty Loss |
|---|---|---|---|
| 31 | Control (No Treatment) | 17.29 | 68.76 |
| 32 | Cpmposition E (1100 ppm) | 8.43 | 30.59 |
| 33 | Composition E (1100 ppm) w/TDA-8 | 8.26 | 27.79 |
| 34 | Composition G (900 ppm) | 2.38 | 7.24 |

Examples 35–39

The following tests show effectiveness of compositions according to the present invention compared to control and conventional compositions using actual alkaline fine mill show water at 150 PPM, at room temperature and at a pH of 8.0, using and Weight Gain Test Procedure A and porosity test as previously described.

The results are depicted in Table 8 below.

TABLE 8

| Example No. | Composition Tested (ppm) | % Change Weight (Weight Gain) | % Change of Porosity Poroisty Loss |
|---|---|---|---|
| 35 | Control (No Treatment) | 13.22 | 44.68 |

TABLE 8-continued

| Example No. | Composition Tested (ppm) | % Change Weight (Weight Gain) | % Change of Porosity Poroisty Loss |
|---|---|---|---|
| 36 | Composition A | 1.21 | 3.51 |
| 37 | Composition H | 0.61 | 6.47 |
| 38 | Composition I | 0.39 | 5.18 |
| 39 | Composition C | 0.46 | 5.91 |

The examples describe various embodiments of the invention. Other embodiments will be apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the following claims.

What is claimed is:

1. A method of inhibiting the deposit of sticky material on a papermill felt used in processing pulp slurry into sheets, comprising applying to said papermill felt at least one cationic polymer and at least one nonionic surfactant having an HLB of about 11 to 14, wherein the at least one cationic polymer is selected from the group consisting of (a) polyethyleneimines, (b) the reaction product of epichlorohydrin and polyalkylene polyamine, (c) the reaction product of epichlorohydrin, dimethylamine and at least one of the group consisting of ethylene diamine, polyalkylene polyamine and N,N,N',N'-tetramethylethyienediamine, (d) cationic tannin derivatives, and (e) cationic polymers derived from ethylenically unsaturated monomers, the polymers being selected from the group consisting of homo-polymers of vinyl compounds, quaternized homo-polymers of vinyl compounds, co-polymers of vinyl compounds, quaternized co-polymers of vinyl compounds, allyl compounds, acrylic derivatives and quaternized acrylic derivatives.

2. The method according to claim 1, wherein the at least one cationic polymer is a polyethylenimine.

3. The method according to claim 1, wherein the at least one cationic polymer is derived by reacting epichlorohydrin and a polyalkylene polyamine.

4. The method according to claim 1, wherein the cationic polymer is a reaction product of epichlorohydrin, dimethylamine and at least one of the group consisting of ethylene diamine and polyalkylene polyamine.

5. The method according to claim 4, wherein the cationic polymer is a reaction product of epichlorohydrin, dimethylamine and N,N,N',N'-tetramethylethylene-diamine.

6. The method according to claim 1, wherein the at least one cationic polymer has a molecular weight of about 2,000 to about 3,000,000.

7. The method according to claim 6, wherein the at least one cationic polymer has a molecular weight of about 10,000 to about 300,000.

8. The method according to claim 7, wherein the at least one cationic polymer has a molecular weight of about 10,000 to about 50,000.

9. The method according to claim 8, wherein the at least one cationic polymer has a molecular weight of about 10,000 to about 20,000.

10. The method according to claim 1, wherein the at least one nonionic surfactant is linear.

11. The method according to claim 1, wherein the cationic polymer is a cationic tannin derivative.

12. The method according to claim 1, wherein the at least one cationic polymer and the at least one nonionic surfactant comprises the cationic polymer having a molecular weight of about 10,000 to about 50,000; and the nonionic surfactant having at least one branched alcohol ethoxylate.

13. The method according to claim 1, wherein the at least one cationic polymer derived from an ethylenically unsaturated monomer is selected from the group consisting of homo-polymers of vinyl compounds, quaternized homo-polymers of vinyl compounds, co-polymers of vinyl compounds, quaternized co-polymers of vinyl compounds, allyl compounds, acrylic derivatives, quaternized acrylic derivatives.

14. The method according to claim 1, wherein the at least one cationic polymer is a cationic polymer derived from ethylenically unsaturated monomers, the polymers being selected from the group consisting of homo-polymers of vinyl compounds, quaternized homo-polymers of vinyl compounds, co-polymers of vinyl compounds, quaternized co-polymers of vinyl compounds, allyl compounds, acrylic derivatives and quaternized acrylic derivatives.

15. The method according to claim 14, wherein the cationic polymer derived from ethylenically unsaturated monomers is a polybutadiene that was reacted with a lower alkyl amine, wherein a portion of a plurality of dialkyl amino groups are quaternized.

16. The method according to claim 15, wherein the cationic polymer derived from ethylenically unsaturated monomer is a reaction product of polybutadiene, carbon monoxide and hydrogen in the presence of a lower alkyl amine.

17. The method according to claim 16 wherein the cationic polymer derived from ethylenically unsaturated monomer is poly(dimetylbutenyl)ammonium chloride bis-(triethanol ammonium chloride).

18. The method according to claim 14, wherein the cationic polymer derived from ethylenically unsaturated monomer is a polymer having the formula:

$$Y-\left[\underset{X^-}{ZN^+R'R''}-\underset{X^-}{Z'N^+R'R''}\right]_n-Z-Y'$$

wherein Z is $-CH_2CH{=}CHCH_2-$ or $-CH_2$-$CHOHCH_2-$; Z' is $-CH_2CH{=}CHCH_2-$ or $-CH_2-CHOHCH_2-$; Y and Y', which may be the same or different, are either X or —NR'R", wherein X is a halogen of atomic weight greater than 30, and wherein R' and R" (I) are the same alkyl group of from 1 to 18 carbon atoms optionally substituted by 1 to 12 hydroxyl groups, (ii) are different alkyl groups of from 1 to 18 carbon atoms optionally substituted by 1 to 12 hydroxyl groups, (iii) taken together with N represent a saturated or unsaturated ring of from about 5 to 7 carbon atoms, or (iv) taken together with N and an oxygen atom represent an N-morpholino group; and n is an integer from 2 to 20.

19. The method according to claim 18, wherein the dissolution assistance agent is an alkyoxyethanol.

20. The method according to claim 1, wherein the at least one cationic polymer having a concentration of at least 2 ppm and the at least one nonionic surfactant are applied in at least one aqueous composition, the at least one cationic polymer.

21. The method according to claim 1, wherein the at least one cationic polymer and the at least one nonionic surfactant are applied in at least one aqueous composition, the at east one cationic polymer having a concentration in the aqueous composition of at least 2 ppm.

22. The method according to claim 21, wherein said cationic polymer has a molecular weight of about 10,000 to about 20,000.

23. The method according to claim 22, wherein said nonionic surfactant comprises at least one branched alcohol ethoxylate.

24. The method according to claim 1, wherein the at least one cationic polymer is derived by reacting epichlorohydrin and a methylethylamine.

* * * * *